US006307314B1

(12) United States Patent
Sano

(10) Patent No.: US 6,307,314 B1
(45) Date of Patent: Oct. 23, 2001

(54) CATHODE RAY TUBE WITH DEFLECTION YOKE INCLUDING NON-CIRCULAR SEPARATOR

(75) Inventor: Yuuichi Sano, Fukaya (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/270,104

(22) Filed: Mar. 16, 1999

(30) Foreign Application Priority Data

Mar. 17, 1998 (JP) ..... 10-066951
Jan. 29, 1999 (JP) ..... 11-021612

(51) Int. Cl.[7] ..... H01J 29/70; H01J 31/00
(52) U.S. Cl. ..... 313/440; 313/477 R
(58) Field of Search ..... 313/477 R, 440, 313/422; 220/2.1 A, 2.1 R; 335/210, 296, 213

(56) References Cited

U.S. PATENT DOCUMENTS 3,731,129 5/1973 Tsuneta et al. .
5,801,481 * 9/1998 Yokota ..... 313/440
5,962,964 * 10/1999 Sano et al. ..... 313/440
6,188,173 * 2/2001 Kang et al. ..... 313/477 R

FOREIGN PATENT DOCUMENTS 48-34349 10/1973 (JP) .
48-85030 11/1973 (JP) .

* cited by examiner

*Primary Examiner*—Nimeshkumar D. Patel
*Assistant Examiner*—Karabi Guharay
(74) *Attorney, Agent, or Firm*—Pillsbury Winthrop LLP

(57) ABSTRACT

A novel cathode ray tube apparatus is disclosed, in which a yoke portion with a deflection yoke mounted thereon has a basically rectangular non-circular section perpendicular to the tube axis. A separator of the deflection yoke has a section perpendicular to the tube axis expressed as $$(M+N)/(2*(M^2+N^2)^{1/2})<(SS+LS)/(2DS)\leqq 0.90$$

where M:N is the aspect ratio, SS the outer diameter along the vertical axis, LS the outer diameter along the horizontal axis, and DS the maximum outer diameter.

7 Claims, 3 Drawing Sheets

CATHODE RAY TUBE WITH DEFLECTION YOKE INCLUDING NON-CIRCULAR SEPARATOR

BACKGROUND OF THE INVENTION

The present invention relates to a cathode ray tube apparatus, or more in particular, to a cathode ray tube apparatus comprising a deflection yoke capable of reducing the deflection power and the leakage magnetic field effectively.

Generally, the cathode ray tube apparatus comprises a vacuum envelope of glass and a deflection yoke forming a deflection magnetic field for deflecting the electron beams. The vacuum envelope includes a rectangular faceplate, a cylindrical neck portion and a funnel portion for coupling the faceplate and the neck portion to each other. The deflection yoke is mounted over the portion extending from the. neck portion to the yoke portion in the funnel portion.

In the cathode ray tube apparatus having this construction, the deflection power supplied to the deflection yoke is the main power consumed in the apparatus. In recent years, in order to satisfy the requirement for high brightness and high definition of the cathode ray tube apparatus, the trend is toward an even more increased deflection power. For the power consumption of the cathode ray tube apparatus to be reduced, however, the deflection power is required to be decreased. Also, with this cathode ray tube apparatus, it is necessary to reduce the magnetic field leaking from the deflection yoke out of the cathode ray tube apparatus.

Generally, for reducing the deflection power and the leakage magnetic field, the outer diameters of the neck portion and the yoke portion are desirably reduced. With this structure, the operating space of the deflection magnetic field is reduced and the operating efficiency of the deflection magnetic field exerted on the electron beams is improved.

In the conventional cathode ray tube apparatus, however, the electron beams pass in proximity to the inner surface of the yoke portion. If the outer diameters of the neck portion and the yoke portion are reduced, therefore, the electron beam having a large deflection angle, that is, having an electron beam trajectory at a large angle to the tube axis impinges on the inner wall of the yoke portion. Such an electron beam fails to reach on the phosphor screen and causes a display failure. In the cathode ray tube apparatus having this construction, it is difficult to reduce the deflection power and the leakage magnetic field by reducing the outer diameters of the neck portion and the yoke portion.

U.S. Pat. No. 3,731,129 discloses a cathode ray tube in which the shape of a section perpendicular to the tube axis of the yoke portion changes progressively from a circle to a rectangle starting with the neck portion toward the faceplate. With this pyramidal yoke portion, the outer diameters of the yoke portion can be reduced without being impinged the electron beam on the inner wall of the yoke portion. Also, with this structure, the deflection magnetic field acts on the electron beam with a comparatively high efficiency.

In the cathode ray tube apparatus of this configuration, however, the side surfaces of the yoke portion flatten more and the environmental pressure resistance of the yoke portion of the envelope is reduced more, the higher the rectangularity of the yoke portion. Thus the safety is adversely affected.

Recently, a flat display unit with a flat outer surface of the faceplate has found an application. In the flat display unit with an outer surface having a radius of curvature at least twice the effective diagonal length of the phosphor screen (the faceplate is completely flat when the radius of curvature is infinitely large), however, the environmental pressure resistance of the faceplate is low and the yoke portion, if pyramidal, decreases also in the environmental pressure resistance, thereby making it difficult to secure a mechanical strength required of the vacuum envelope as a whole for safety. The strength of the vacuum envelope, that is, the environmental pressure resistance and the mechanical strength thereof combined will hereinafter be collectively called the bulb strength.

The two requirements described above, that is, a rectangular section of the yoke portion in order to sufficiently reduce the deflection power and the leakage magnetic field on the one hand and a sufficient bulb strength even with a rectangular section of the yoke portion on the other, cannot be met at the same time by the conventional cathode ray tube apparatus. It is especially difficult for the cathode ray tube apparatus with a flat display unit to reduce the deflection power and the leakage magnetic field and a sufficient bulb strength at the same time.

BRIEF SUMMARY OF THE INVENTION

The present invention has been developed to solve the above-mentioned problem and the object thereof is to provide a cathode ray tube apparatus comprising a vacuum envelope including a substantially pyramidal yoke portion of a sufficient bulb strength and a deflection yoke following the shape of the yoke portion, which can meet the requirement for high brightness and high definition even after the deflection power and the leakage magnetic field are reduced.

According to the present invention, there is provided a cathode ray tube apparatus comprising:

a vacuum envelope including a faceplate having on the inner surface thereof a rectangular phosphor screen having an aspect ratio M:N between the length along the horizontal axis perpendicular to the tube axis and the length along the vertical axis perpendicular to the tube axis and the horizontal axis, a cylindrical neck portion having an electron gun assembly built therein for emitting electron beams in the direction along the tube axis, a funnel portion for connecting the faceplate and the neck portion, and a yoke portion of which a section perpendicular to the tube axis on the neck portion side of the funnel portion changes in shape from a circle of the same diameter as the neck portion to a non-circle having a maximum diameter in other than the directions along the horizontal axis and the vertical axis; and a deflection yoke mounted on the outer surface of the vacuum envelope and extending from the neck portion to the yoke portion for forming a deflection magnetic field for deflecting the electron beams;

wherein in the case where the distance between the tube axis and the outer surface of the yoke portion is the outer diameter of the yoke portion, the yoke portion is a non-circle with at least a section perpendicular to the tube axis having a maximum outer diameter in a direction other than the vertical axis and the horizontal axis;

wherein the deflection yoke includes a cylindrical separator interposed between a horizontal deflection coil and a vertical deflection coil for forming the deflection magnetic field; and wherein assuming that the outer diameter of the separator is equal to the distance between the tube axis and the outer surface of the separator, at least a section of the separator perpendicular to the tube axis is a non-circle having a maximum outer diameter in other than the directions along the vertical axis and the horizontal axis.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
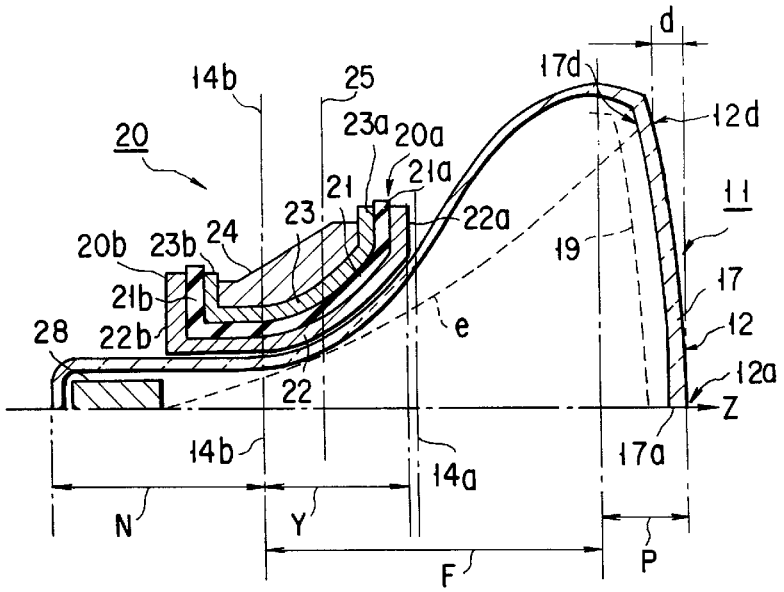
FIG. 1 is diagram schematically showing a configuration of a cathode ray tube apparatus according to the invention, as cut away in a part of a section containing the tube axis.

A cathode ray tube apparatus according to an embodiment of the present invention will be described in detail below with reference to the drawings.

In the conventional cathode ray tube apparatus having a substantially pyramidal yoke portion disclosed in Jpn. Pat. Appln. KOKAI Publication No. 48-34349, the horizontal deflection sensitivity alone is emphasized, and therefore only the horizontal deflection coil is formed in pyramidal shape, while the vertical deflection coil is formed in substantially conical shape like the cathode ray tube apparatus having a substantially conical yoke portion.

The configuration in which only the horizontal deflection coil is pyramidal, however, cannot meet the requirement for high resolution and wide deflection angle.

First, for the deflection power to be reduced for the purpose of saving energy, it has been found effective to substantially form in a pyramidal shape the vertical deflection coil as well as the horizontal deflection coil and further to substantially construct in a pyramidal shape the core portion including a magnetic material constituting the magnetic core of the magnetic field formed by the deflection coils. Also, for meeting the requirement of a wider deflection angle, it is necessary to reduce the vertical deflection sensitivity as well as the horizontal deflection sensitivity. The substantially conical vertical deflection coil of the conventional cathode ray tube having a pyramidal yoke portion, therefore, cannot be considered to have an optimal shape.

In recent years, more and more rigid restrictions have been imposed on the magnetic field leaking around the cathode ray tube apparatus from the deflection yoke. Generally, indexes VLMF and ELMF are used for quantitatively expressing the leakage magnetic field. The former is an index mainly used for expressing the leakage magnetic field originating from the horizontal deflection coil. The latter index is for mainly expressing the leakage magnetic field originating from the vertical deflection coil. The leakage magnetic field is stronger, the larger the coil diameter at the end of the deflection coil (bend portion) nearer to the screen, that is, the larger the distance between the tube axis and the coil. The wide-angle deflection tube, therefore, has an especially strong leakage magnetic field.

In other words, it is impossible to reduce the leakage magnetic field, especially, ELMF, in the case where a conical vertical deflection coil is used for the conventional cathode ray tube having a pyramidal yoke portion. In another case where a section, perpendicular to the tube axis, of the separator interposed between the horizontal deflection coil and the vertical deflection coil is elliptical, the diameter along the horizontal axis assumes a maximum length, and the coil diameter at the end of the vertical deflection coil nearer to the screen cannot be reduced. It is therefore difficult to reduce the ELMF.

In view of this, according to this invention, the coil diameter at the end of the deflection coil nearer to the screen can be reduced by forming the horizontal and vertical deflection coils in a substantial pyramid and also forming in a sufficient pyramid the end of the deflection coil nearer to the screen. This, combined with the effect of the reduced deflection power described above, can sufficiently reduce VLMF and ELMF. Also, in addition to this configuration, a substantially pyramidal corporation can further reduce the deflection power, VLMF and ELMF. Further, this configuration of the deflection coil can provide a compact, lightweight deflection yoke as compared with an ordinary conical deflection yoke or a conventional deflection yoke in which only the horizontal deflection coil is pyramidal.

Now, an explanation will be given of a deflection yoke and a cathode ray tube apparatus having the deflection yoke according to an embodiment of the invention.

This invention provides a cathode ray tube apparatus comprising a vacuum envelope including a yoke portion having an optimum shape capable of reducing the deflection power and securing a sufficient bulb strength at the same time, and a deflection yoke of an optimum shape mounted on the yoke portion, when the yoke portion of the vacuum envelope is formed in a substantially pyramidal shape.

Figure 2:
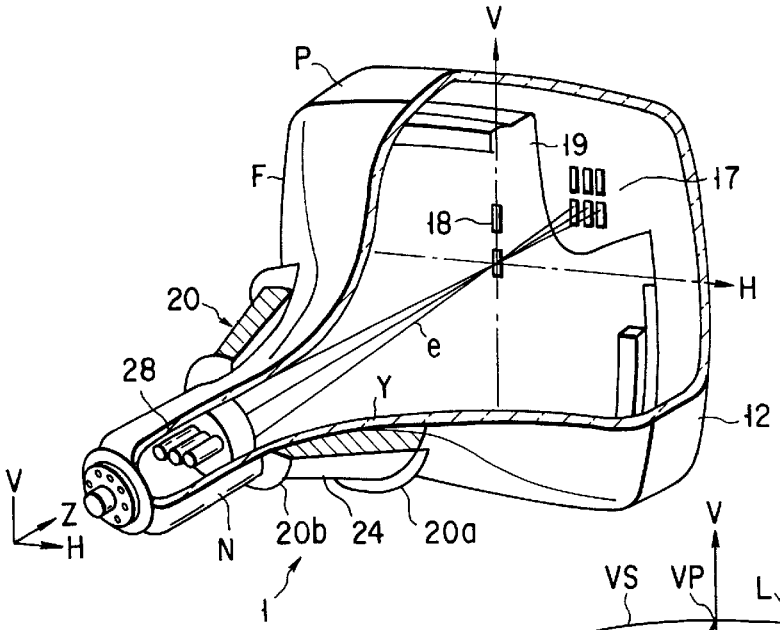
FIG. 2 is a partial sectional view schematically showing an outer appearance and an internal structure of the cathode ray tube apparatus of FIG. 1.

As shown in FIGS. 1 and 2, a cathode ray tube apparatus 1 comprises a vacuum envelope 11 made of glass and a deflection yoke 20 forming a deflection magnetic field for deflecting the electron beam. The vacuum envelope 11 includes a faceplate P having a substantially rectangular effective faceplate surface 12, a cylindrical neck portion N having a center axis coincident with the tube axis and a funnel portion F for coupling the faceplate P and the neck portion N to each other. The funnel portion F includes, on the neck portion N side thereof, a yoke portion Y having the deflection yoke 20 mounted thereon.

The faceplate P includes on the inner surface thereof a phosphor screen 17 having striped or dotted three-color phosphor layers for emitting red, green and blue light, respectively. In this case, the flatness of the faceplate P is defined by the radius of curvature of the outline of the faceplate P approximated to a circle. Specifically, the radius of curvature of the faceplate P is determined by approximation of a circle based on a head d toward the neck portion N along the tube axis Z at a diagonal screen end 12*d* between the center 12*a* of the faceplate P and the diagonal screen end 17*d*. According to this embodiment, the flatness in terms of radius of curvature of the faceplate P is more than twice the effective diagonal length of the effective faceplate 12. In the case where the radius of curvature is infinitely large, it indicates that the outer surface of the faceplate P is completely flat. In other words, this invention is applicable to what is called the flat display unit having a faceplate P having a substantially flat outer surface.

The faceplate P includes a shadow mask 19 arranged in spaced and opposed relation to the phosphor screen 17. This shadow mask 19 has on the inner surface thereof a multiplicity of apertures 18 for passing the electron beams.

The neck portion N includes therein an electron gun assembly 28 for emitting three electron beams e aligned and passing in the same horizontal plane, that is, what is called the in-line electron gun assembly. The three electron beams e are aligned along the horizontal axis H and emitted along the direction parallel to the tube axis Z. Of the three electron beams, the electron beam constituting the center beam proceeds along the trajectory nearest to the center axis of the neck portion N. The electron beams constituting a pair of side beams proceed along the trajectories on the both sides of the center beam.

The electron gun assembly 28 converges the three electron beams e toward the phosphor screen 17 while at the same time focusing each of the three electron beams e on the phosphor screen 17.

The deflection yoke 20, as shown in FIG. 1, includes a horizontal deflection coil 22 for forming a horizontal deflection magnetic field in pin-cushion form, a vertical deflection coil 23 for forming a vertical deflection magnetic field in barrel form, a cylindrical separator 21 interposed between the horizontal deflection coil 22 and the vertical deflection coil 23, and a core portion 24 of high permeability formed of a cylindrical magnetic material. The deflection yoke 20 forms a non-uniform deflection magnetic field for deflecting the electron beam by the horizontal deflection coil 22 and the vertical deflection coil 23.

As described above, in order to solve the various problems of the conventional apparatus, the horizontal deflection coil 22, the vertical deflection coil 23 and the core portion 24 surrounding these deflection coils are required to be substantially pyramidal in shape. For this to be realized, it is necessary to form a substantially pyramidal separator 21 interposed between the horizontal deflection coil 22 and the vertical deflection coil 23. Specifically, the horizontal deflection coil 22 is formed in a shape following the inner surface of the separator 21, and the vertical deflection coil 23 in a shape following the outer surface of the separator 21. In other words, the shape of the deflection yoke 20 can be defined by specifying the shape of the separator 21.

The separator 21 is formed of a horn-shaped synthetic resin, plastics or the like having a smaller aperture on the neck portion N side than on the faceplate P side thereof. The separator 21 has, in a section containing the tube axis as shown in FIG. 1, an end nearer to the screen along the tube axis Z, that is, a flange 21*a*, and an end nearer to the neck portion, that is, a flange 21*b*. The horizontal deflection coil 22 is of a saddle type. The horizontal deflection coil 22 has an end nearer to the screen along the tube axis Z, that is, a bend 22*a* and an end nearer to the neck portion, that is, a bend 22*b*. The horizontal deflection coil 22 is fixed in a groove formed in the inner wall of the separator 21. The vertical deflection coil 23 is of saddled type. The vertical deflection coil 23 has an end nearer to the screen along the tube axis Z, that is, a bend 23*a*, and an end nearer to the neck portion, that is, a bend 23*b*. The vertical deflection coil 23 is fixed on the outer wall of the separator 21. The core portion 24 is fixedly arranged around the outer periphery of the horizontal deflection coil 22 and the vertical deflection coil 23 and constitutes a magnetic core of the deflection magnetic field.

The separator 21 is formed as a substantial pyramid having at least a substantially rectangular section perpendicular to the tube axis. Specifically, the separator 21 is formed as a substantial pyramid having a substantially rectangular inner surface profile. Thus, the horizontal deflection coil 22 arranged to match the inner surface profile is formed as a substantial pyramid having a substantially rectangular section. Also, the separator 21 is formed as a substantial pyramid with an outline having a substantially rectangular section. The vertical deflection coil 23 arranged to follow this outline, therefore, is formed as a substantial pyramid having a substantially rectangular section.

As a result, the magnetic field leaking from the deflection yoke 20 can be reduced by combining the saddle-type horizontal deflection coil 22 and the saddle-type vertical deflection coil 23 and thus by reducing the coil diameter of the portion nearer to the screen.

In the cathode ray tube apparatus having this structure, the three electron beams e emitted from the electron gun assembly 28 are deflected while being self-converged by the non-uniform deflection magnetic field generated by the deflection yoke 20. Specifically, the three electron beams e scan the phosphor screen 17 in the directions of the horizontal axis H and the vertical axis V, respectively, through the shadow mask 19. As a result, a color image is displayed.

As shown in FIG. 1, the outline of the funnel portion F along the tube axis Z is formed substantially in a S-shaped curve from the faceplate side to the neck portion side. Specifically, the funnel portion F is formed convex on the faceplate P side thereof, and concave on the neck portion N side of the yoke portion Y. The boundary 14*a* on the faceplate side of the yoke portion Y is the inflection point of the S-shaped curve. The boundary 14*b* on the neck portion N side of the yoke portion is a junction with the neck portion N. The deflection yoke 20 is mounted in such a position that the end portion 20*a* on the faceplate side thereof is located in the neighborhood of the boundary 14*a*. The end portion 20*b* on the neck portion side of the deflection yoke 20 is located at a position corresponding to the neck portion beyond the boundary 14*b*. A deflection reference point 25 is located in the range of the yoke portion Y.

Figure 5A:
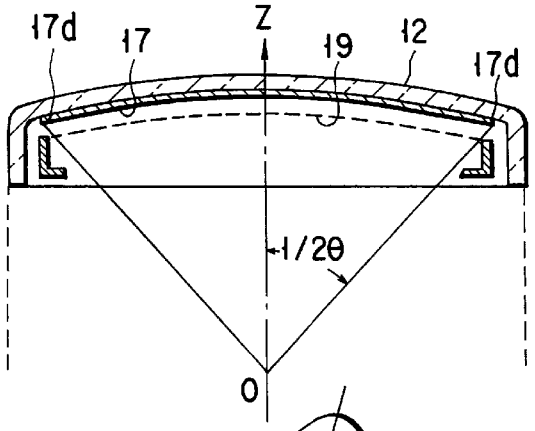
FIG. 5A is a sectional view of the faceplate of the cathode ray tube apparatus shown in FIG. 1, taken along a diagonal thereof, and FIG. 5B a plan view of the faceplate of the cathode ray tube apparatus of FIG. 1.
Figure 5B:
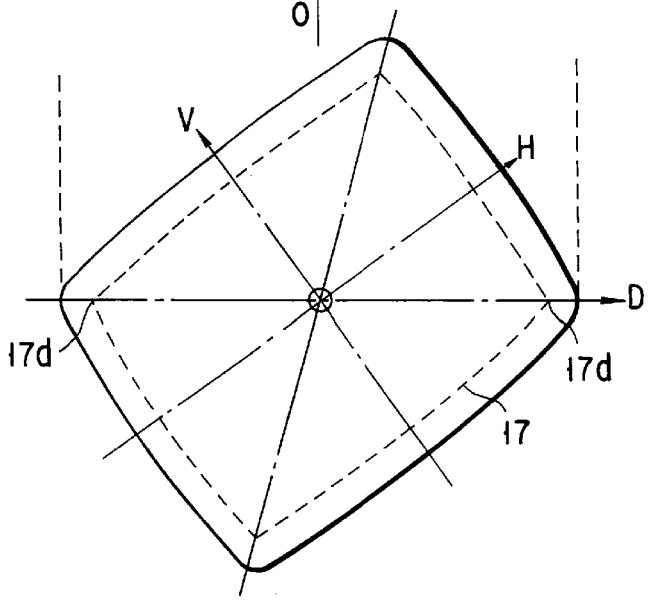

The deflection reference point 25 is defined as follows. As shown in FIGS. 5A and B, draw two lines connecting the ends 17*d* of the screen diagonals on both sides of the tube axis Z and a particular point 0 on the tube axis Z. The deflection reference point 25 is defined as the point 0 on the tube axis Z, when the angle between two lines corresponds to a maximum deflection angle θ according to the specification of the cathode ray tube apparatus. This deflection reference point 25 constitutes the deflection center about which the electron beam is deflected.

Figure 3:
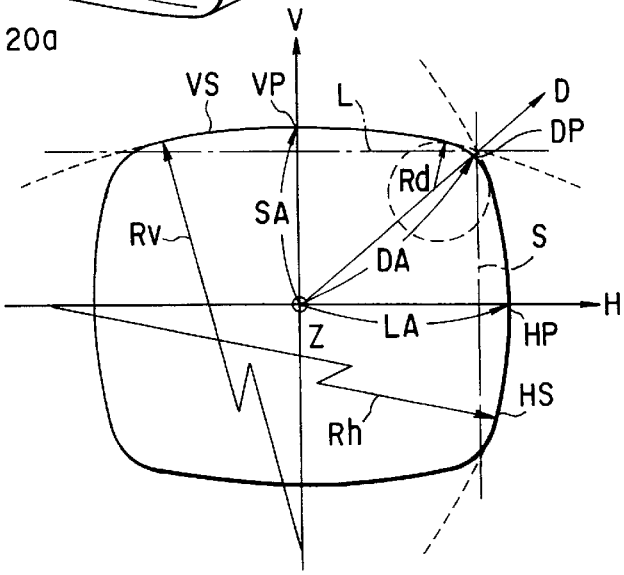
FIG. 3 is a sectional view schematically showing the outline of a section of the yoke portion of the cathode ray tube apparatus, taken in the direction perpendicular to the tube axis at a reference deflection point.

As shown in FIG. 3, the sectional shape of the outline of the yoke portion perpendicular to the tube axis at the deflection reference point 25 is not circular. Specifically, let HP an intersection between the horizontal axis H and the outline of the yoke portion, VP an intersection between the vertical axis V and the outline of the yoke portion, and DP an intersection between the diagonal axis D and the outline of the yoke portion. Also, let LA be the distance from the tube axis Z to the intersection H, SA be the distance from the tube axis Z to the intersection VP, and DA be the distance from the tube axis Z to the intersection DP.

Then, the outline of the yoke portion is a non-circle in which an outer diameter other than the horizontal axis H and the vertical axis V assumes a maximum value. The sectional shape of the outline of the yoke portion shown in FIG. 3 is a substantial rectangle in which LA and SA are smaller than DA, and DA assumes the largest value.

In the cathode ray tube apparatus having the yoke portion of this shape, therefore, the deflection coils arranged in the neighborhood of the intersections HP and VP can be moved near to the electron beams, and therefore the operating efficiency of the deflection magnetic field exerted on the electron beams can be improved. As a result, the deflection power can be reduced. Also, the coil diameter at the end nearer to the faceplate, the bend 22*a*, and the bend 23*a* can be reduced. As a result, the leakage magnetic field can be reduced.

In the example shown in FIG. 3, the diameter along the diagonal axis D is the largest of all. However, the diameter along the diagonal axis D is not necessary largest of all.

In the sectional shape of the outline of the yoke portion, the main surface outline VS crossing the vertical axis V is formed in an arc having a radius of curvature Rv having the center on the vertical axis V. The main surface outline HS crossing the horizontal axis H is formed in an arc having a radius of curvature Rh having the center on the horizontal axis H. Further, the outline of the yoke portion in the neighborhood of the intersection DP is an arc having a radius of curvature Rd having the center on the diagonal axis D. The outline of the yoke portion is shaped by connecting these arcs. These surface outlines can alternatively be defined using other various formulae. In this way, the outline of the yoke portion is a non-circle which is never recessed toward the tube axis from the long side L and the short side S of the rectangle. In the example shown in FIG. 3, the yoke portion has an outline of a barrel-shaped section and is substantially formed in a pyramid.

The nearer to the rectangle is the section of the yoke portion shaped, the bulb strength of the vacuum envelope is deteriorated more, while the deflection power and the leakage magnetic field can be reduced more. An index of the rectangularity of the sectional shape is defined as $$X=(LA+SA)/(2DA)$$

In the case where the outline of the yoke portion is a cone having a circular section, LA and SA are equal to DA, and therefore the index X is 1. In the case where the outline of the yoke portion is a pyramid having a rectangular section, DA is the same as the cone for securing a margin between the outermost electron beam trajectory and the inner wall of the yoke portion. LA and SA, however, are smaller than for the cone. In other words, LA and SA are smaller than DA and therefore the index is smaller than 1.

In the case where the outline of the yoke portion is a perfect pyramid, let the aspect ratio of the rectangular section (ratio between the length along the horizontal axis and the length along the vertical axis) be M:N. Then, the index X is given as $$X=(M+N)/(2*(M^2+N^2)^{1/2})$$

This index X is the result of reducing the outer diameters in horizontal and vertical directions for converting the outline of the yoke portion into a rectangle. Nevertheless, the simulation analysis shows that the deflection power can be reduced in substantially similar fashion also when the outer diameter only in the horizontal or vertical direction is reduced. Therefore, emphasis on LA or SA alone is not required.

Analysis was also made as to a point on the tube axis from which the outline of the yoke portion starts to be rectangular to assure a maximum effect. As a result, it was discovered that it is crucial to form a rectangle of the portion extending from the neighborhood of the deflection reference point 25 to the end portion 20*a* on the screen side of the deflection yoke 20.

FIG. 1 shows an example trajectory of an electron beam e deflected toward the diagonal end 17*d* of the phosphor screen by the deflection magnetic field. As the center of the deflection magnetic field approaches the neck portion from the deflection reference point 25, the deflection magnetic field on the neck portion side is strengthened, so that the electron beam e is deflected more on the neck portion side. As a result, the electron beam e deflected toward the diagonal end 17*d* impinges on the inner wall of the yoke portion. In the case where the center of the deflection magnetic field is nearer to the screen as seen from the deflection reference point 25, in contrast, the margin increases between the electron beam e and the inner wall of the yoke portion. Consequently, the end portion 20*b* of the deflection yoke on the neck portion side thereof can be extended and thus the deflection power can be further reduced.

Also with a cathode ray tube apparatus having an outer diameter different from that of the neck portion described above, the shape of the yoke portion, though different generally up to the deflection reference point 25, is substantially the same on the screen side from the deflection reference point 25. Therefore, analysis may generally reach the same result.

Now, an explanation will be given of the reduction in deflection power.

Figure 4:
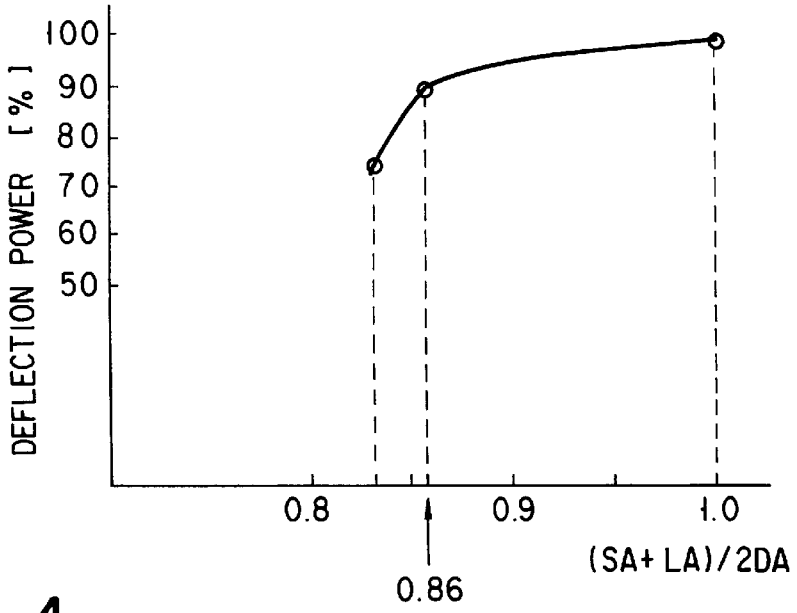
FIG. 4 is a diagram showing the relation between the configuration of the yoke portion of the cathode ray tube apparatus and the deflection power.

FIG. 4 shows the result of simulation of the deflection power with respect to the rectangularity index X of a section perpendicular to the tube axis at the deflection reference point 25.

This simulation assumes that the specification of the deflection yoke is same and that the deflection coils 22, 23 and the core portion 24 approach the electron beam by an amount of the increase in the rectangularity of the yoke portion. The deflection power is the horizontal one supplied to the horizontal deflection coil 22. The deflection power for deflecting the electron beam e at a predetermined deflection rate in a cathode ray tube apparatus having the index X of 1 is assumed to be 100%.

As shown in FIG. 4, when the index X decreases from 0.86 approximately, the deflection power begins to suddenly decrease. Specifically, in the case where the electron beam e is deflected at a predetermined deflection rate, the deflection power can be reduced by about 10 to 30% as compared with a conical yoke portion (X=1). For the index X of 0.86 or more, in contrast, the deflection power cannot be reduced by more than 10%.

To summarize, by making the yoke portion of the vacuum envelope of a substantial pyramid meeting the following conditions, the deflection power can be reduced while at the same time securing the bulb strength. Specifically, when the aspect ratio of a substantially rectangular phosphor screen is M:N, assume that the aspect ratio of the rectangular section of the pyramidal yoke portion substantially coincides with the aspect ratio of the phosphor screen. Then, the aspect ratio of the yoke portion section is regarded as M:N. Also, a section perpendicular to the tube axis at the deflection reference point 25 is assumed to have a shape satisfying the relation $$(M+N)/(2*(M^2+N^2)^{1/2})<(SA+LA)/(2DA)\leqq 0.86$$

where SA is the outer diameter of the yoke portion along the vertical axis, LA is the outer diameter of the yoke portion along the horizontal axis, and DA is the maximum outer diameter of the yoke portion.

Also, as shown in FIG. 3, the outline of the yoke portion having a section perpendicular to the tube axis at the deflection reference point 25 is a substantial rectangle not protruded toward the tube axis Z. The outline of this rectangle can be approximated by an arc having a radius of curvature Rv with the center on the vertical axis, an arc having a radius of curvature Rh with the center on the horizontal axis and an arc having a radius of curvature Rd with the center on the straight line connecting a point associated with the maximum outer diameter and the tube axis. At the same time, the sectional shape of the yoke portion is configured to assure Rh or Rv of 900 mm or less. Thus, a sufficient bulb strength can be secured. The above-mentioned fact is applicable. also to the case where the aspect ratio of the phosphor screen is 4:3, 16:9 or 3:4.

The separator 21 included in the deflection yoke 20 is formed in such a manner as to have the index X of rectangularity described below, taking into consideration the distribution of the winding of the deflection coil.

Figure 6:
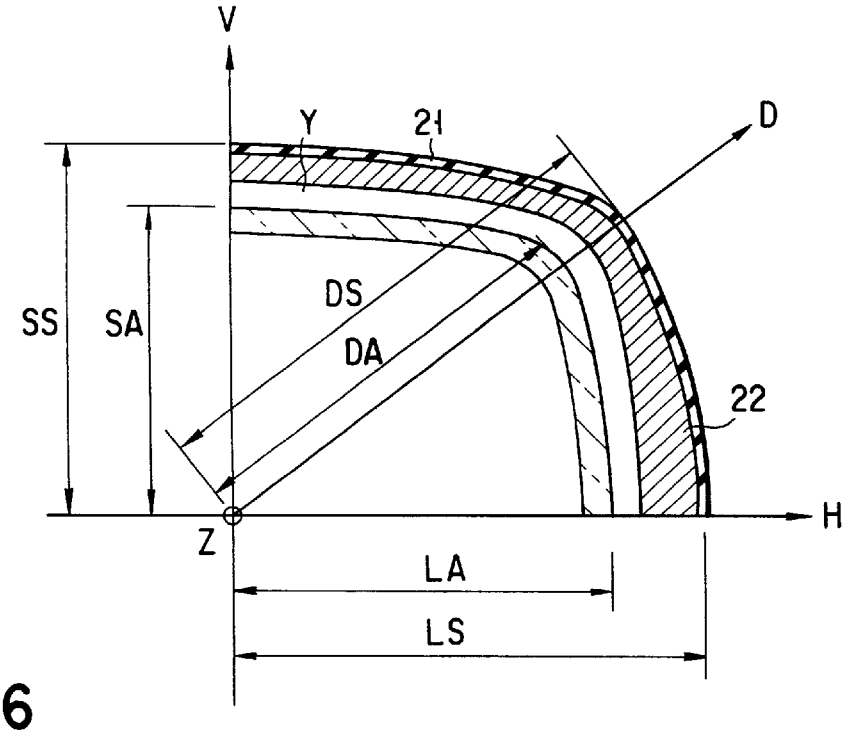
FIG. 6 is a partial sectional view for explaining the dimensions and size of the yoke portion, the horizontal deflection coil and the separator of the cathode ray tube apparatus according to this invention, take in a section perpendicular to the tube axis.

Specifically, as shown in FIG. 6, in the section perpendicular to the tube axis Z, the horizontal deflection coil 22 arranged along the inner surface of the separator 21 has such a distribution as to assure a large sectional area of the winding in the neighborhood of the horizontal axis H in order to form a deflection magnetic field of pin-cushion type. The winding of the horizontal deflection coil 22 is distributed so that the sectional area decreases progressively away from the horizontal axis H.

In other words, the shape of the separator 21 is determined taking into consideration the rectangularity of the outline of the yoke portion Y and the section thereof perpendicular to the tube axis and the distribution of the sectional area of the horizontal deflection coil 22.

Figure 7:
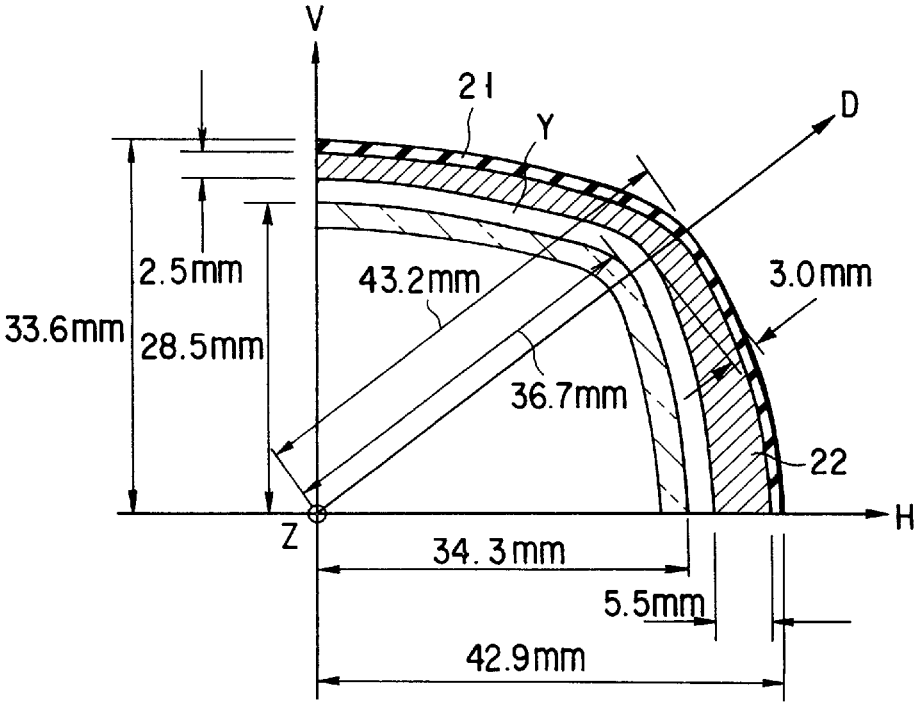
FIG. 7 is a diagram showing an example of the dimensions of the yoke portion, the horizontal deflection coil and the separator shown in FIG. 6.

As a result of detailed study using various simulations and test products, it has been found, as shown in FIG. 7, that the horizontal deflection coil 22 desirably forms such a distribution as to have a thickness of about 5.5 mm on the horizontal axis H, about 2.5 mm on the vertical axis V and about 3 mm on the diagonal axis D. As shown in FIG. 7, therefore, in the case where the rectangularity of the yoke portion Y has an index X of 0.86 (=(28.5+34.3)/(2×36.7)), taking the distribution of the winding of the horizontal deflection coil 22 into consideration, the index X on the outer surface of the separator 21 is 0.89 (=(33.6+42.9)/(2×43.2)) which is larger than that for the yoke portion Y. As a result, the separator 21 is desirably formed to have an index X of not more than about 0.9.

To summarize, the outline of the separator 21 in a section perpendicular to the tube axis Z is a substantial circle similar to the outline of the neck portion between the end 21*b* and the boundary 14*b*. Assuming that the distance between the tube axis Z and the outer surface of the separator 21 is equal to the outer diameter of the separator 21, the outer diameter LS along the horizontal axis and the outer diameter SS along the vertical axis decrease progressively toward the screen along the tube axis Z away from the boundary 14*b*. As a result, the section perpendicular to the tube axis on the screen side of the separator 21 from the boundary 14*b* assumes a non-circle or a rectangle having a maximum inner diameter DS larger than LS and SS. The horizontal deflection coil 22 is configured to substantially follow the inner surface of the separator 21 having a non-circular section. The section on the screen side of the horizontal deflection coil 22, as shown in FIG. 6, is formed to have a rectangular inner profile about 2 to 3 mm away from the outline of the pyramidal yoke portion Y. The vertical deflection coil 23 is configured to substantially follow the outer surface of the separator 21 having a non-circular section. The separator 21 having this sectional shape is formed to have a rectangularity index X of $$(M+N)/(2*(M^2+N^2)^{1/2})<(SS+LS)/(2DS)\leqq 0.90$$

where LS is the outer diameter along the horizontal axis, SS the outer diameter along the vertical axis, DS the maximum outer diameter, and M:N the aspect ratio of the phosphor screen. It is assumed here that the aspect ratio of the phosphor screen substantially coincides with that of the separator in a section perpendicular to the tube axis Z.

A preferred embodiment will be explained below.

The basic structure is described above and will not described in detail.

The vacuum envelope 11 includes a pyramidal yoke portion Y having at least a substantially rectangular section perpendicular to the tube axis Z. The deflection yoke 20 includes a pyramidal separator 21 with at least a section perpendicular to the tube axis Z having a substantially rectangular inner and outer profiles, a substantially pyramidal saddle-type horizontal deflection coil 22 formed along the inner surface of the separator 21, a substantially pyramidal saddle-type vertical deflection coil 23 formed along the outer surface of the separator 21, and a core portion 24 made of a magnetic material having a substantially pyramidal inner profile surrounding the deflection coils. The horizontal deflection coil 22 is formed with space about 2 to 3 mm away from the outer surface of the yoke portion Y having a pyramidal outline.

As shown in FIG. 6, the sectional shape of the yoke potion Y, the estimated range of distribution of the horizontal deflection coil 22 and the sectional shape of the separator 21 in a section perpendicular to the tube axis Z at the end of the vertical deflection coil 23 nearer to the screen are defined by the following dimensions, for example. In this case, the aspect ratio of the yoke portion Y is assumed to substantially coincide with that of the phosphor screen, and the aspect ratio M:N of the phosphor screen is assumed to be 4:3.

The outline of the yoke portion Y is such that the maximum outer diameter DA is 38.3 mm, the outer diameter along the horizontal axis LA is 35.00 mm, and the outer diameter along the vertical axis SA is 28.4 mm. Thus, the rectangularity index X of the yoke portion Y is given as $$X=(LA+SA)/(2*DA)=0.83$$

This shape of the yoke portion Y makes it possible to reduce the deflection power and to secure the bulb strength at the same time.

Also, the outer profile of the separator 21 is such that the maximum outer diameter DS is 45.4 mm, the outer diameter along the horizontal axis LS is 43.6 mm, the outer diameter along the vertical axis SS is 34.1 mm. Thus, the rectangularity index X of the separator 21 is given as $$X=(LS+SS)/(2*DS)=0.86$$

The profile of the separator 21 is formed in a rectangular shape following the outline of the yoke portion Y in a section perpendicular to the tube axis Z as described above, so that the horizontal deflection coil 22 arranged on the inner surface of the separator 21 and the vertical deflection coil 23 arranged on the outer surface of the separator 21 also assume a rectangular shape.

As a consequence, as compared with the conventional cathode ray tube having a conical yoke portion, the horizontal deflection power can be reduced by about 20% and the vertical deflection power by 17%. Also, since the coil diameter at the end of the deflection coil nearer to the screen can be reduced, the leakage magnetic field also decreases by 50% in terms of VLMF and by 22% in terms of ELMF. Further, the yoke temperature increase $\Delta T$ can be reduced by about 7° C.

As described above, according to this invention, there is provided a cathode ray tube apparatus wherein the yoke portion of the vacuum envelope has a pyramidal shape in at least a rectangular section perpendicular to the tube axis, and the separator of the deflection yoke assumes a shape of pyramid having at least a rectangular section perpendicular to the tube axis following the outline of the yoke portion. Also, the horizontal deflection coil formed along the inner surface of the separator is formed in a pyramidal shape along the outer surface of the yoke portion. The vertical deflection coil formed along the outer surface of the separator is formed in the shape of pyramid.

With this configuration, the deflection characteristic considerably superior to that of the conventional cathode ray tube apparatus can be obtained with a smaller deflection power and a smaller leakage magnetic field. Also, a cathode ray tube apparatus is provided which can meet the requirement for high brightness and a high resolution at the same time.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A cathode ray tube apparatus comprising:

a vacuum envelope including a faceplate having on the inner surface thereof a rectangular phosphor screen having an aspect ratio M:N between the length along the horizontal axis perpendicular to the tube axis and the length along the vertical axis perpendicular to the tube axis and the horizontal axis, a cylindrical neck portion having an electron gun assembly built therein for emitting electron beams in the direction along the tube axis, a funnel portion for connecting said faceplate and said neck portion, and a yoke portion of which a section perpendicular to the tube axis on the neck portion side of the fimnel portion changes in shape from a circle of the same diameter as the neck portion to a non-circle having a maximum diameter in other than the directions along the horizontal axis and the vertical axis;

wherein said yoke portion has at least a section perpendicular to said tube axis expressed as $$(M+N)/(2*(M^2+N^2)^{1/2})<(SA+LA)/(2DA)\leqq 0.86$$

where SA is the outer diameter along the vertical axis, LA the outer diameter along the horizontal axis, and DA the maximum outer diameter; and a deflection yoke mounted on the outer surface of the vacuum envelope and extending from said neck portion to the yoke portion for forming a deflection magnetic field for deflecting the electron beams;

wherein said yoke portion is a non-circle with at least a section perpendicular to the tube axis having a maximum outer diameter in a direction other than the vertical axis and the horizontal axis where the distance between said tube axis and the outer surface of said yoke portion is the outer diameter of the yoke portion;

wherein said deflection yoke includes a cylindrical separator interposed between a horizontal deflection coil and a vertical deflection coil for forming said deflection magnetic field; and wherein the outer diameter of the separator is equal to the distance between the tube axis and the outer surface of said separator, at least a section of said separator perpendicular to said tube axis is a non-circle having a maximum outer diameter in other than the directions along the vertical axis and the horizontal axis; and said separator has at least a section perpendicular to said tube axis expressed as $$(M+N)/(2*(M^2+N^2)^{1/2})<(SS+LS)/(2DS)\leqq 0.90$$

where SS is the outer diameter along the vertical axis, LS the outer diameter along the horizontal axis, and DS the maximum outer diameter.

2. A cathode ray tube apparatus according to claim 1, wherein in the case where an outline of said faceplate is approximated to a circle, a radius of curvature thereof is at least twice the effective diagonal length of said phosphor screen.

3. A cathode ray tube apparatus according to claim 1, wherein said horizontal deflection coil is arranged along the inner surface of said separator and said vertical deflection coil is arranged along the outer surface of said separator.

4. A cathode ray tube apparatus according to claim 3, wherein said horizontal deflection coil is shaped in a substantial pyramid.

5. A cathode ray tube apparatus according to claim 3, wherein said vertical deflection coil is shaped in a substantial pyramid.

6. A deflection yoke mounted on an outer surface area extending from a neck portion to a yoke portion of the vacuum envelope of a cathode ray tube apparatus, comprising:

a horizontal deflection coil forming a horizontal deflection magnetic field for deflecting the electron beam in the direction of the horizontal axis substantially parallel to a long side of a phosphor screen;

a vertical deflection coil forming a vertical, deflection magnetic field for deflecting the electron beam in the direction of the vertical axis substantially parallel to a short side of the phosphor; and a cylindrical separator interposed between said horizontal deflection coil and said vertical deflection coil;

wherein at least a section of said separator perpendicular to said tube axis is a non-circle having a maximum outer diameter in a direction other than the directions along said vertical axis and said horizontal axis where the distance between said tube axis and the outer surface of said separator is the outer diameter of said separator, and the section perpendicular to said tube axis is expressed as $$(M+N)/(2*(M^2+N^2)^{1/2})<(SS+LS)/(2DS)\leqq 0.90$$

where M:N is the aspect ratio of the phosphor screen, SS is the outer diameter along the vertical axis, LS is the outer diameter along the horizontal axis, and DS is the maximum outer diameter.

7. A deflection yoke according to claim 6, comprising a core portion formed of a magnetic material surrounding said horizontal deflection coil and said vertical deflection coil, wherein said core portion is formed in a substantial pyramid.

* * * * *